US008745946B2

(12) United States Patent
D'Alessandro et al.

(10) Patent No.: US 8,745,946 B2
(45) Date of Patent: Jun. 10, 2014

(54) CEILING TILE SUSPENSION SYSTEM

(76) Inventors: Enzo D'Alessandro, Concord (CA); Fabbio D'Alessandro, Concord (CA)

( * ) Notice: Subject to any disclaimer, the term of this patent is extended or adjusted under 35 U.S.C. 154(b) by 0 days.

(21) Appl. No.: 13/371,695

(22) Filed: Feb. 13, 2012

(65) Prior Publication Data

US 2013/0205702 A1 Aug. 15, 2013

(51) Int. Cl.

| | |
|---|---|
| ***E04B 9/10*** | (2006.01) |
| *E04B 9/18* | (2006.01) |
| *E04B 9/20* | (2006.01) |
| *E04B 9/22* | (2006.01) |

(52) U.S. Cl.

CPC ... *E04B 9/10* (2013.01); *E04B 9/18* (2013.01); *E04B 9/205* (2013.01); *E04B 9/225* (2013.01)

USPC ..... 52/506.05; 52/506.06; 52/508; 52/775

(58) Field of Classification Search

CPC ..... E04B 9/10; E04B 9/18; E04B 9/183; E04B 9/20; E04B 9/205; E04B 9/225

USPC ..... 52/506.05, 506.06, 508, 764, 769, 772, 52/775, 780

See application file for complete search history.

(56) References Cited

U.S. PATENT DOCUMENTS

| | | | | |
|---|---|---|---|---|
| 5,619,833 | A * | 4/1997 | Neff | 52/506.05 |
| 7,621,090 | B2 * | 11/2009 | Kelley et al. | 52/506.07 |
| 8,359,802 | B1 * | 1/2013 | Burnett et al. | 52/506.08 |
| 8,555,594 | B2 * | 10/2013 | Grandi | 52/506.05 |

* cited by examiner

*Primary Examiner* — Mark Wendell
*Assistant Examiner* — Matthew J Smith
(74) *Attorney, Agent, or Firm* — Gable Gotwals

(57) ABSTRACT

A ceiling tile suspension system comprising a clip member, a suspension track releasably securable to the clip member and a ceiling tile suspension rail releasably securable to the suspension track. The clip member is securable to a structural component of a ceiling and has an upper surface and a pair of downwardly depending sides. The suspension track is releasably securable to the clip member and has a pair of upwardly extending legs. At least the sides of the clip member or the legs of the suspension track are horizontally resiliently displaceable to releasably secure the suspension track to the clip member.

9 Claims, 7 Drawing Sheets

CEILING TILE SUSPENSION SYSTEM

FIELD

The present invention relates to a device and a system that may be used to support ceiling tiles from structural members of a ceiling.

BACKGROUND

A suspended ceiling utilizing ceiling tiles as the primary aesthetic structure of the ceiling is common in residential and commercial applications alike. The use of ceiling tiles is in many instances an attractive option as it presents the ability to easily and quickly construct a finished ceiling without the cost and mess associated with installing drywall. Further, ceiling tiles provide the ability to maintain easy access to a ceiling compartment for purposes of running pipes and wires, for servicing issues within the ceiling, etc.

Typically, ceiling tiles are held in place by a suspended metallic frame system, often referred to as a "T-bar" rail system. T-bar ceilings are named after the cross-sectional shape of the metallic bars which support the ceiling tiles. T-bar rails are commonly hung from structural members of the ceiling (whether they be floor joists, concrete pads, etc.), using metal wires or hangers. Although installing the T-bar rails is in most instances less laborious than installing drywall, it can nevertheless still be a labour intensive and tedious task that requires individual rails to be wired in place and carefully leveled in order to present a smooth flat and level finished ceiling surface. In the case of residential applications, T-bar ceilings are most commonly used in basement applications where maintaining access to the ceiling joists can be important for the reasons indicated above. In such instances it is often desirable to secure the T-bar rail system in place as close to the bottom surface of the floor joists as possible in order to maximize headroom. Unfortunately, due to the nature of the T-bar rail and the fact that it is typically wired in place, in most instances there will be a loss of head room of at least a number of inches (often 4 to 6).

There is therefore a need for an improved ceiling tile suspension system that addresses at least some of the deficiencies in currently available products.

SUMMARY

The described device therefore provides a new and improved ceiling tile suspension system that addresses a number of the short comings of current products. In one aspect there is provided a ceiling tile suspension system comprising a clip member securable to a structural component of a ceiling, said clip member having an upper surface and a pair of downwardly depending sides; a suspension track releasably securable to said clip member, said suspension track having a pair of upwardly extending legs, at least said sides of said clip member or said legs of said suspension tracks horizontally resiliently displaceable to releasably secure said suspension track to said clip member; and, a ceiling tile suspension rail releasably securable to said suspension track.

In as further aspect there is provided a kit comprising a plurality of clip members, suspension tracks and ceiling tile suspension rails, said clip members securable to a structural component of a ceiling and each having a pair of downwardly depending sides, said suspension tracks each having a pair of upwardly extending legs, at least said legs of said suspension track or said sides of said clip member horizontally resiliently displaceable to releasably secure said suspension track to said clip member, said ceiling tile suspension rails releasably securable to said suspension tracks such that when said clip members are secured to a structural component of the ceiling with said suspension tracks releasably secured to said clip members and said ceiling tile suspension rails releasably secured to said suspension tracks, said clip members, suspension tracks and ceiling tile suspension rails collectively permitting ceiling tiles to be suspended from the ceiling.

Further aspects and advantages will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DESCRIPTION

The present invention may be embodied in a number of different forms. However, the specification and drawings that follow describe and disclose only some of the specific forms of the invention. The scope of the claims should not be limited by the preferred embodiments set forth herein, but should be given the broadest interpretation consistent with the description as a whole.

Figure 1:
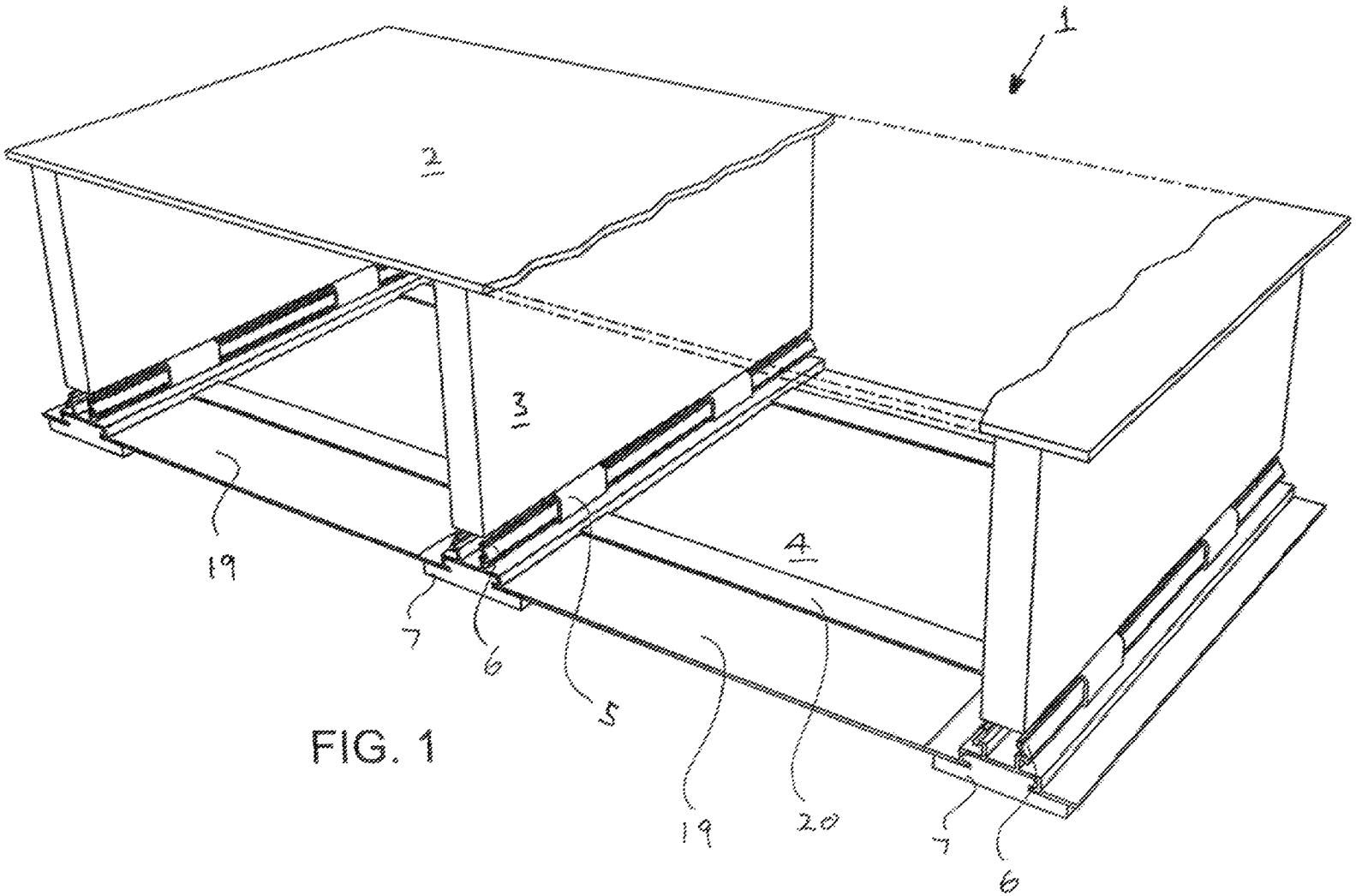
FIG. 1 is an upper side perspective view of a sub-floor (shown partially removed), floor joists and a ceiling tile suspension system constructed in accordance with an embodiment of the present invention.
Figure 2:
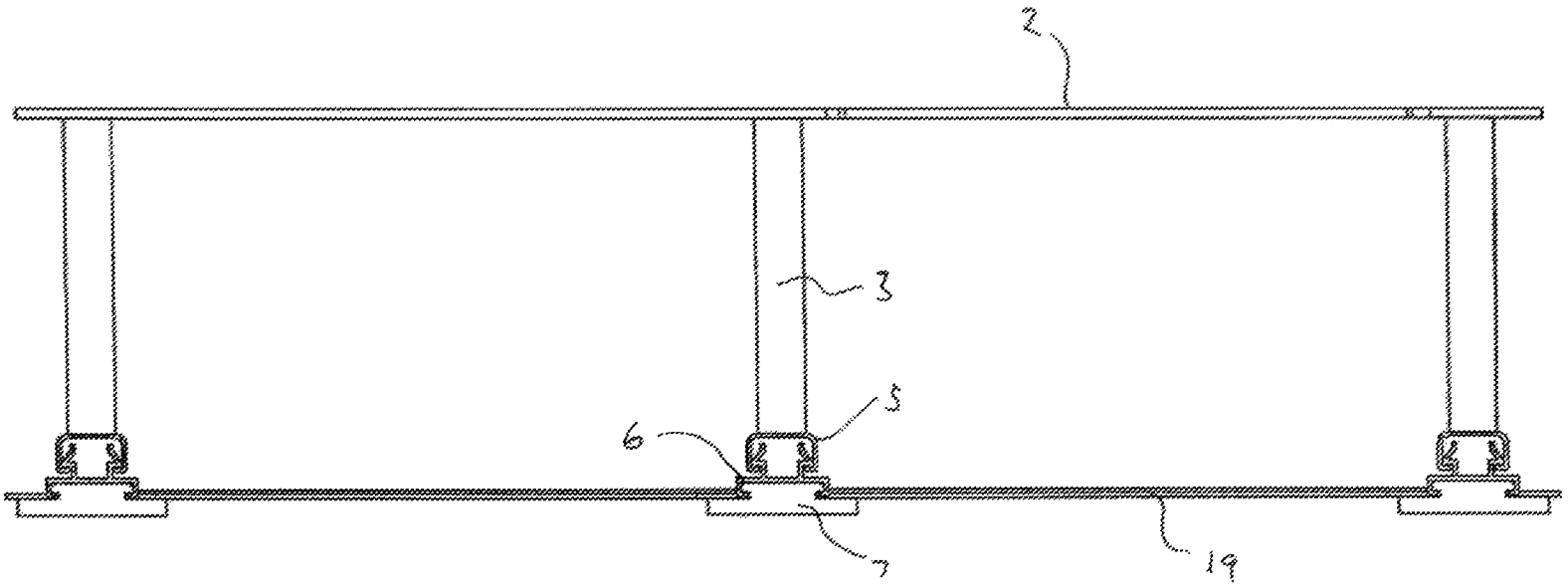
FIG. 2 is an end elevational view of the subfloor and ceiling suspension system shown in FIG. 1.

With reference to the attached drawings, in FIG. 1 there is shown an upper side perspective view of a sub-floor 1 wherein the flooring material 2 (plywood, etc.) has been partially removed to better show the floor joists 3 and a ceiling tile suspension 4 constructed in accordance with an embodiment of the invention. The specifics of ceiling tile suspension system 4 are shown more clearly in the subsequent Figures, which indicate that suspension system 4 comprises a clip member 5, a suspension track 6 and a ceiling tile suspension rail 7. Clip member 5 is securable to a structural component of the ceiling, such as floor joists 3, through the use of any one of a wide variety of fastening means, which may include nails, screws, bolts, adhesives, etc. Although the clip members may be of a variety of different lengths, typically the clips will be in the range of a few inches long (for example 6 to 10 inches) and will be spaced out at relatively consistent spacing (for example 1 to 2 feet) along the lower surface of the floor joists (see FIG. 1). It will become apparent from a thorough understanding of the invention that individual clip members may serve as a bridge between the abutting ends of two lengths of suspension track.

Figure 3:
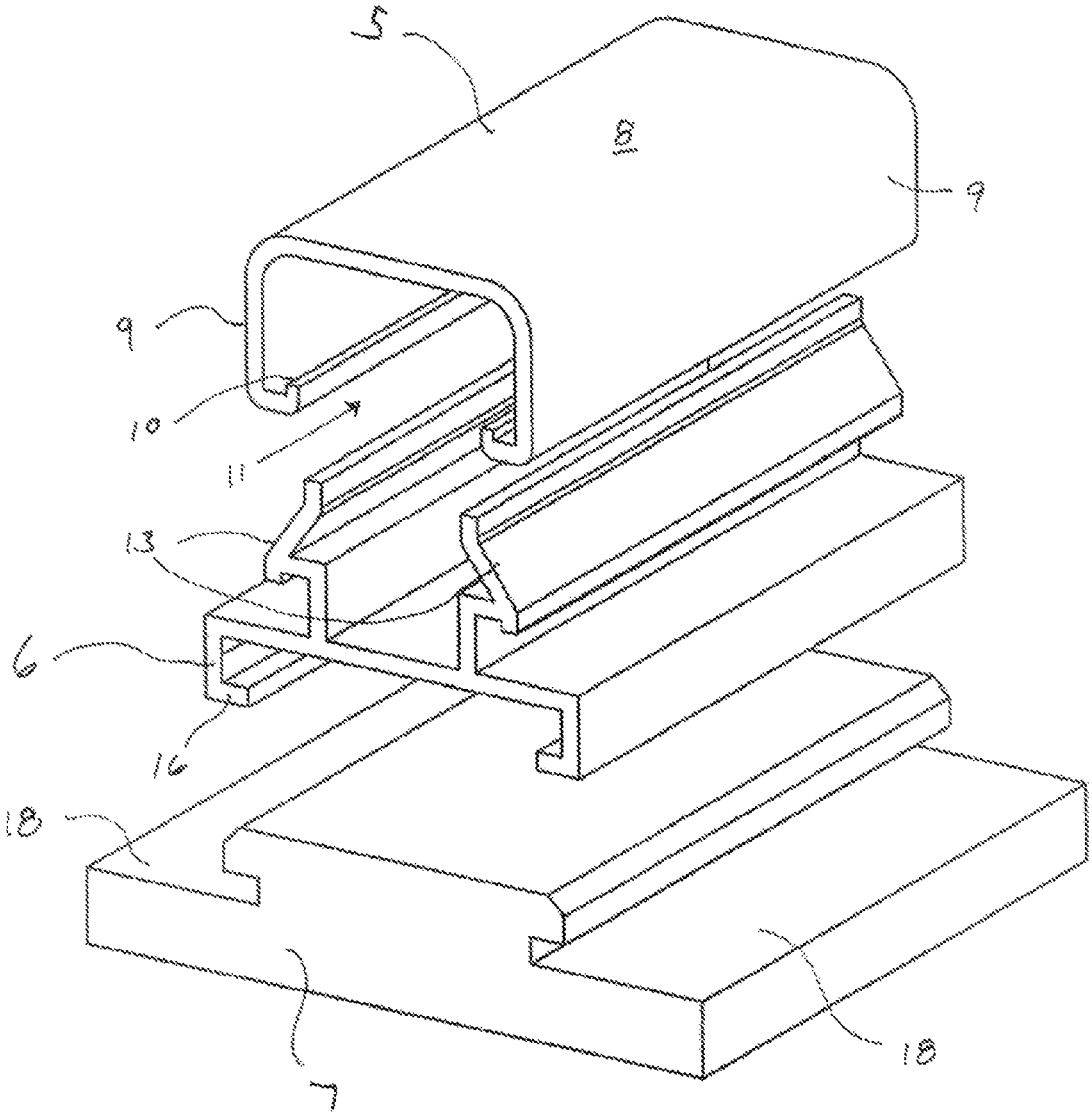
FIG. 3 is an upper side perspective exploded view of the ceiling tile suspension system in accordance with an embodiment of the present invention.
Figure 10:
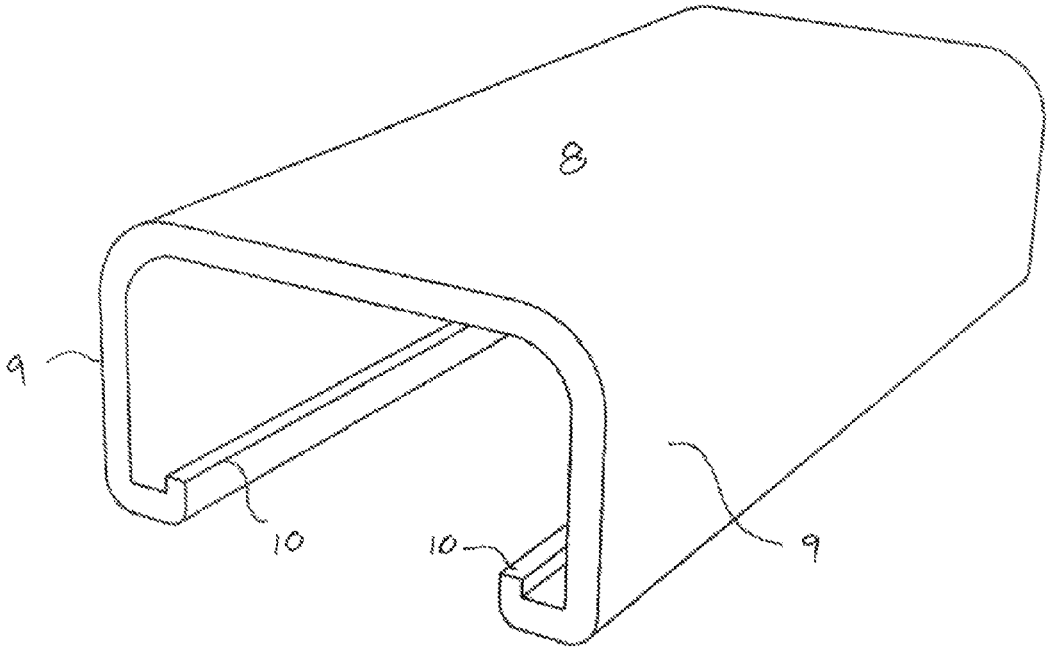
FIG. 10 is an upper side perspective view of the clip member shown in FIG. 5; and, FIG. 11 is an end view of the clip member shown in FIG. 10.
Figure 11:
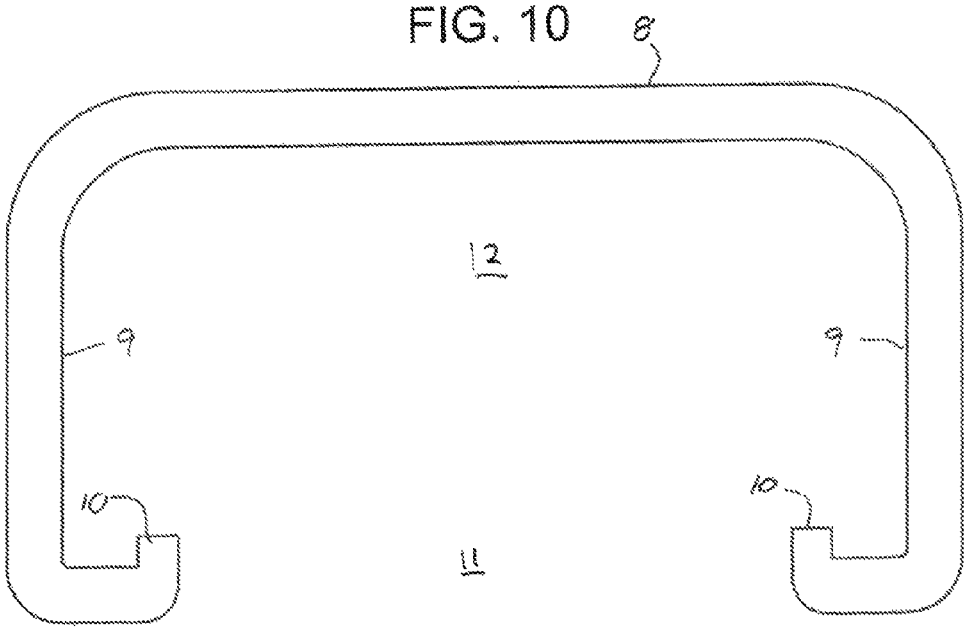

As shown more particularly in FIGS. 3, 10 and 11, in one embodiment clip member 5 has an upper surface 8 and a pair of downwardly depending sides 9 that terminate in upwardly oriented lips 10. In the attached drawings, upwardly oriented lips 10 are situated on the inside surface of downwardly depending sides 9 of clip member 5. However, in alternate embodiments of the invention lips 10 could be located on the outside surfaces of downwardly depending sides 9. It will also be understood from a review of the attached drawings that in the depicted embodiment clip member 5 has a generally open bottom 11 and a generally hollow interior 12.

Figure 4:
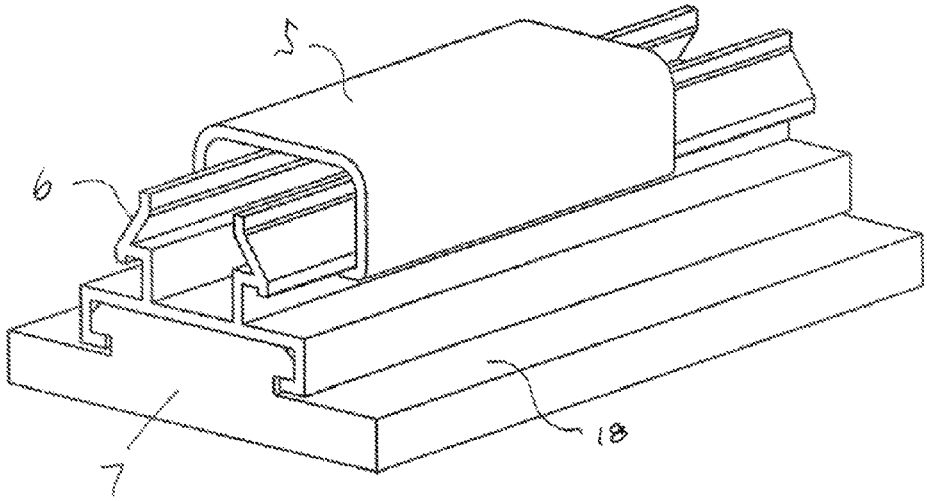
FIG. 4 is an upper side assembled view of the ceiling tile suspension system shown in FIG. 3.
Figure 5:
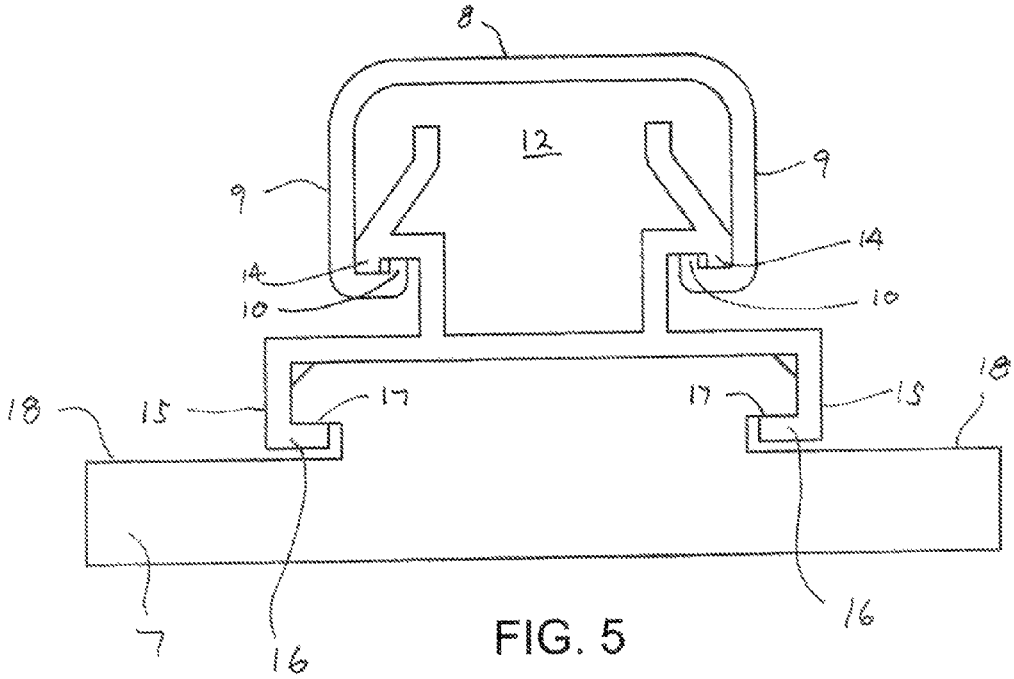
FIG. 5 is an end view of the ceiling tile suspension system shown in FIG. 4.
Figure 6:
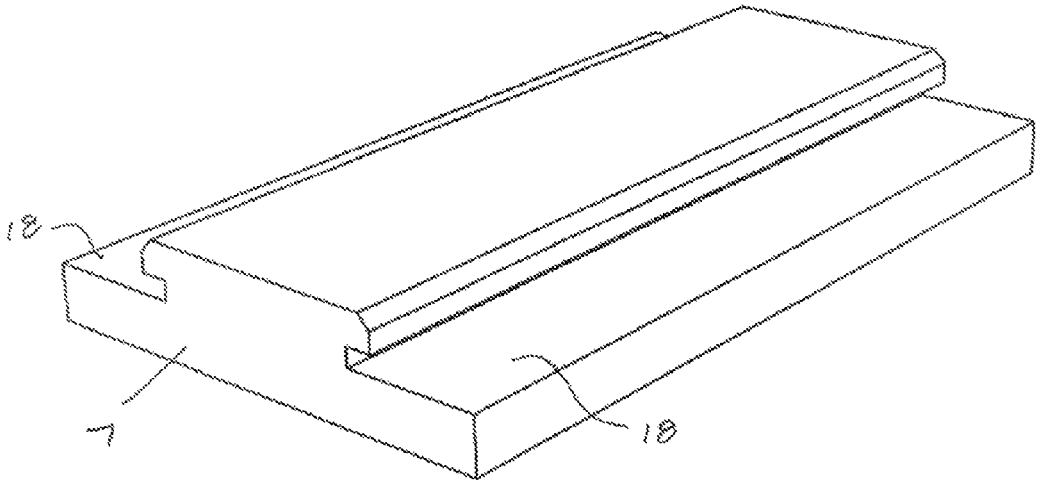
FIG. 6 is an upper side perspective view of the ceiling tile suspension rail of FIG. 5.
Figure 7:
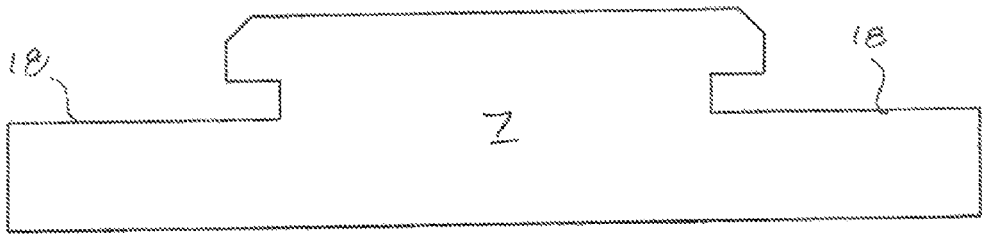
FIG. 7 is an end view of the ceiling tile suspension rail shown in FIG. 6.
Figure 8:
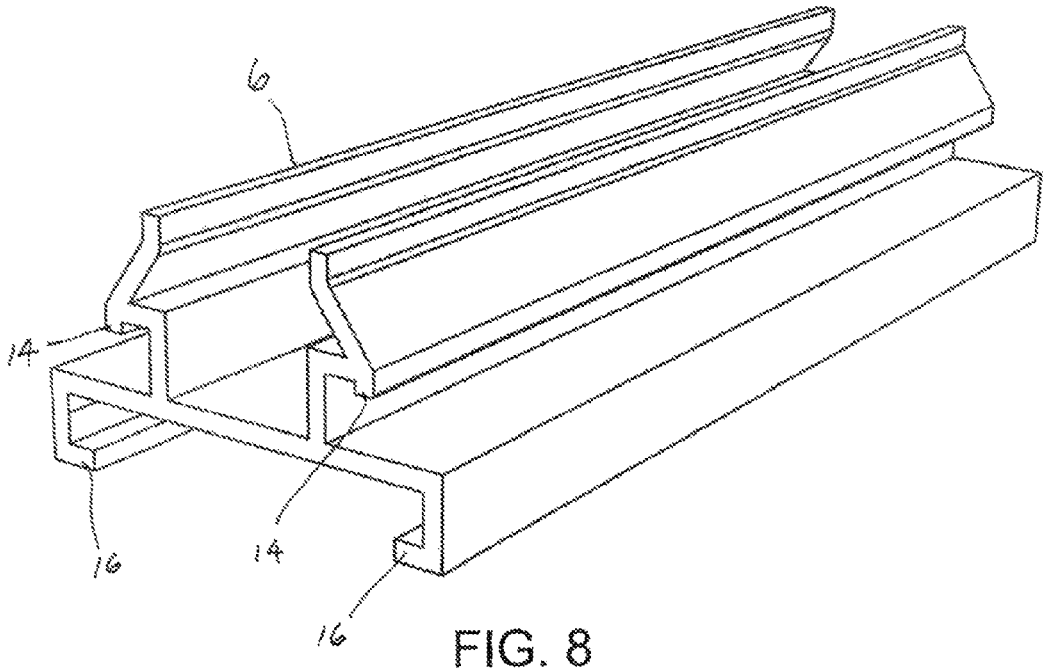
FIG. 8 is an upper side perspective view of the suspension track shown in FIG. 5.
Figure 9:
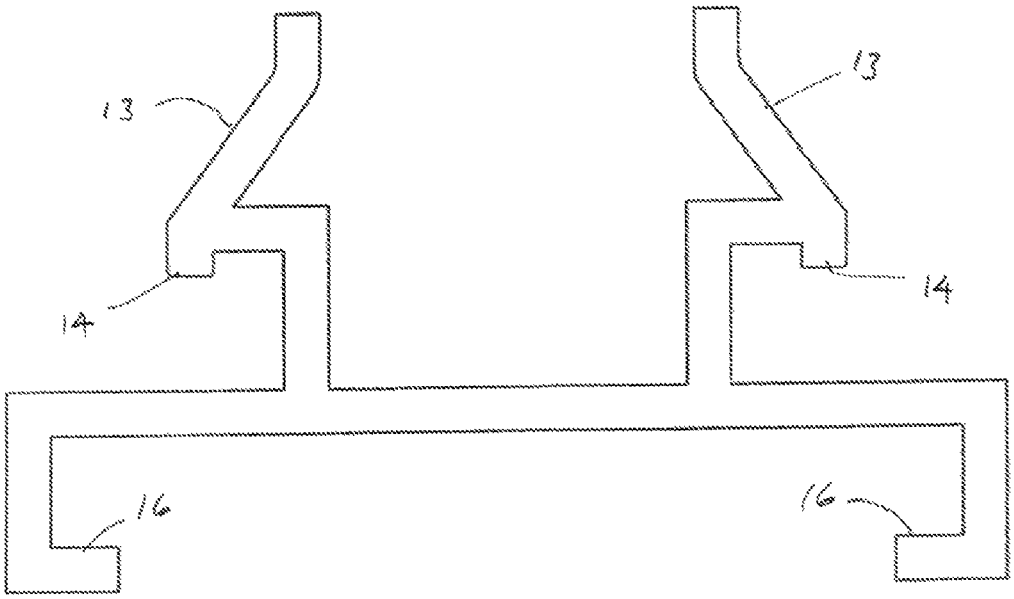
FIG. 9 is an end view of the suspension track shown in FIG. 8.

Referring next to FIGS. 3 through 5, suspension track 6 includes a pair of upwardly extending legs 13 that in one embodiment of the invention are horizontally resiliently displaceable to releasably secure track 6 to clip member 5. Where legs 13 are horizontally displaceable they are preferably displaceable from a rest position to a displaced position, at which point the upper portions of the legs are receivable into hollow interior 12 of clip member 5. Once received within the hollow interior of the clip member the upper ends of legs 13 releasably secure the track to clip member 5 through the receipt of a pair of downwardly extending longitudinal rails 14 on the track over upwardly extending lips 10 of the clip member. That is, when the upper ends of legs 13 are received within the hollow interior of the clip movement of the legs from their displaced position back to their rest position will cause rails 14 to interlock with lips 10 and releasably secure the suspension track in place, effectively hanging it from the clip members.

In order to facilitate the receipt of the upper ends of legs 13 of the track into the interior of clip member 5 at least legs 13 of suspension track 6 or sides 9 of clip 5 are flexibly resilient and biased toward their rest position. In one aspect of the invention both clip member 5 and suspension track 6 are formed from a flexibly resilient plastic material. In such a case releasably securing the suspension track to the clip member merely requires pushing the suspension track upwardly into the hollow interior of the clip member causing legs 13 of suspension track 6 and/or sides 9 of clip member 5 to horizontally displace, allowing the suspension track to "snap" into place within the hollow interior of the clip. In other instances it may be solely sides 9 of clip member 5 that are displaced outwardly in order to accommodate the receipt of legs 13 until such time as the legs have been inserted sufficiently into the clip member to allow longitudinal rails 14 to slide over lips 10. At that point the sides of the clip member snap back into place, effectively causing the suspension track to be hung from the clip member, and thus from the bottom of floor joists 3. As mentioned, in other cases the sides of the clip member may be rigid and legs 13 horizontally displaceable.

Suspension track 6 also preferably includes a pair of spaced apart downwardly extending side members 15 that terminate in inwardly directed flanges 16. As shown particularly in FIGS. 4 and 5, ceiling tile suspension rail 7 has a generally T-shaped upper ridge with generally outwardly oriented landing surfaces 17 that engage and are received over flanges 16 on side members 15 of suspension track 6 to releasably secure the suspension rail to the suspension track. It is expected that in most instances securing the suspension rail to the suspension track in this manner will require the insertion of the upper T-shaped ridge of the suspension rail longitudinally through the lower portion of the suspension track to hang the rail from inwardly extending flanges 16.

Ceiling tile suspension rail 7 also includes longitudinal ceiling tile support surfaces 18 that run along the upper surfaces of each side of the suspension rail. Support surfaces 18 are dimensioned to receive and support the edges of a ceiling tile 19 thereon. It will be appreciated that depending upon the aesthetic look that is desired, ceiling tile suspension rail 7 could be manufactured from any one of a wide variety of different materials including, metals, woods and plastic. As shown in FIG. 1, lateral "T" or "H" slats 20 will extend between parallel ceiling tile suspension rails 7 in order to support the lateral edges of the ceiling tile and present a finished appearance between the ends of two abutting tiles. In most instances it is expected that slats 20 will be formed from the same material as ceiling tile suspension rail 7 and will form a uniform look therewith.

Accordingly, it will be appreciated that the above described ceiling tile suspension system presents a relatively simple, fast and effective mechanism that permits ceiling tiles to be suspended from the structural components of a ceiling. Hanging or supporting ceiling tiles merely requires the securing of a plurality of clip members 6 to the bottom surface of a series of floor joists. Ceiling tile suspension rails 7 can then be inserted into suspension tracks 6, after which the legs 13 of the tracks 6 can be pushed upwardly into clip member 5 until the legs "snap" into place. At that point the suspension track will effectively be hung from clip members 5 with ceiling tile suspension rail 7 effectively being hung from suspension track 6. The structure can thus be easily and quickly installed along the bottom surfaces of joists 3 or, alternatively, could be installed over existing drywall or other ceiling structures.

It will also be appreciated from an examination and understanding of the invention that the described ceiling tile suspension system can be mounted to a ceiling without consuming a significant amount of vertical height. It has been found that the described ceiling tile suspension system can be manufactured to occupy a height of approximately 1¼ inches when assembled, serving to minimize the loss of head room, which can be particularly important in cases of basement renovations where the amount of head room is often a premium. Once clip members 5, suspension tracks 6 and ceiling tile suspension rails 7 have been secured to the bottom surfaces of joists 3, ceiling tiles 19 can be supported on support surfaces 18, much as is the case when utilizing traditional aluminum T-bar rails.

It will also be understood that dismantling the ceiling tile suspension system will merely require that downwardly depending sides 9 of clip members 5 and/or the upper portions of legs 13 of suspension track 6 be displaced inwardly, in order to disengage the rails of the suspension track from the upwardly oriented lips of the clip members. In some cases displacing the suspension track from the clip members may be accomplished through the application of a sufficient downwardly oriented force, the torsional twisting of the suspension track, or through the insertion of a screwdriver or other hand tool between legs 13 and sides 9 in order to disengage rails 14 from lips 10.

It is to be understood that what has been described are the preferred embodiments of the invention and that it may be possible to make variations to these embodiments. Some of these variations have been discussed while others will be readily apparent to those skilled in the art.

We claim:

1. A ceiling tile suspension system comprising:

a clip member securable to a structural component of a ceiling, said clip member having an upper surface and a pair of downwardly depending sides;

a suspension track releasably securable to said clip member, said suspension track having a pair of upwardly extending legs, at least said sides of said clip member or said legs of said suspension track horizontally resiliently displaceable to releasably secure said suspension track to said clip member, said suspension track further including a pair of spaced apart downwardly extending side members that terminate in inwardly extending flanges; and, a ceiling tile suspension rail releasably securable to said suspension track, said ceiling tile suspension rail including longitudinal ceiling tile support surfaces to receive and support the edge of a ceiling tile, said ceiling tile suspension rail including outwardly oriented flanges that engage said inwardly extending flanges on said side members of said suspension track to releasably secure said suspension rail to said suspension track.

2. The ceiling tile suspension system as claimed in claim 1 wherein said downwardly depending sides of said clip member terminate in upwardly oriented lips.

3. The ceiling tile suspension system as claimed in claim 2 wherein said legs of said suspension track include downwardly extending longitudinal rails, said rails received over said upwardly oriented lips of said clip when said suspension track is releasably secured to said clip.

4. The ceiling tile suspension system as claimed in claim 2 wherein said downwardly depending sides of said clip member are horizontally flexibly resilient.

5. The ceiling tile suspension system as claimed in claim 1 wherein said clip member and said suspension track are formed from flexibly resilient plastic.

6. The ceiling tile suspension system as claimed in claim 1 including fasteners to secure said clip member to a structural component of the ceiling.

7. The ceiling tile suspension system as claimed in claim 1 wherein said clip member has a generally open bottom and a generally hollow interior.

8. The ceiling tile suspension system as claimed in claim 7 wherein said legs of said suspension track are displaceable from a rest position to a displaced position, when in said displaced position said legs receivable through said generally open bottom and into said generally hollow interior of said clip member, when said legs received with said hollow interior of said clip member movement of said legs from said displaced to said rest position releasably securing said suspension track to said clip member.

9. The ceiling tile suspension system as claimed in claim 7 wherein said downwardly depending sides of said clip member are displaceable from a rest position to a displaced position, when in said displaced position said sides permitting said legs of said suspension track to be receivable through said generally open bottom and into said generally hollow interior of said clip member, when said legs received within said generally hollow interior of said clip member movement of said downwardly depending sides of said clip member from said displaced to said rest position releasably securing said suspension track to said clip member.

* * * * *